US009878898B2

(12) United States Patent
Zweifel

(10) Patent No.: US 9,878,898 B2
(45) Date of Patent: Jan. 30, 2018

(54) CATCH RELEASING CAPLESS FUEL-FILLER BOTTLE

(71) Applicant: ALPHA CONSOLIDATED HOLDINGS, INC., St. Louis, MO (US)

(72) Inventor: James A. Zweifel, Seville, OH (US)

(73) Assignee: Alpha Consolidated Holdings, Inc., St. Louis, MO (US)

( * ) Notice: Subject to any disclaimer, the term of this patent is extended or adjusted under 35 U.S.C. 154(b) by 0 days.

(21) Appl. No.: 14/818,238

(22) Filed: Aug. 4, 2015

(65) Prior Publication Data

US 2016/0031697 A1 Feb. 4, 2016

Related U.S. Application Data

(60) Provisional application No. 62/033,103, filed on Aug. 4, 2014, provisional application No. 62/059,827, filed on Oct. 3, 2014.

(51) Int. Cl.

| | |
|---|---|
| ***B67D 7/42*** | (2010.01) |
| ***B67D 7/02*** | (2010.01) |
| ***B65D 1/02*** | (2006.01) |
| ***B65D 41/04*** | (2006.01) |

(52) U.S. Cl.

CPC ..... *B67D 7/42* (2013.01); *B65D 1/0246* (2013.01); *B65D 41/04* (2013.01); *B67D 7/0288* (2013.01)

(58) Field of Classification Search

CPC .... B65D 1/0246; B65D 41/04; B67D 7/0288; B67D 7/42

USPC ..... 141/350, 353, 355, 366

See application file for complete search history.

(56) References Cited

U.S. PATENT DOCUMENTS

| | | | |
|---|---|---|---|
| 135,430 | A | 2/1873 | Howson et al. |
| 1,279,695 | A | 9/1918 | Frank et al. |
| 1,351,496 | A | 8/1920 | Spooner |
| 1,577,020 | A | 3/1926 | Hammer et al. |
| 2,135,330 | A | 11/1938 | Desser et al. |

(Continued)

FOREIGN PATENT DOCUMENTS

| | | | |
|---|---|---|---|
| CA | 2721234 | A1 | 12/2009 |
| CN | 103260979 | A | 8/2013 |

(Continued)

OTHER PUBLICATIONS

PCT International Search Report & Written Opinion for International Patent Application No. PCT/US2015/043683, dated Oct. 7, 2015 (12 pages).

*Primary Examiner* — Timothy L Maust
*Assistant Examiner* — Andrew Schmid
(74) *Attorney, Agent, or Firm* — Dorsey & Whitney LLP

(57) ABSTRACT

Disclosed herein is a sealable bottle. The bottle includes a pouring spout portion which projects from the bottle and has an interior surface defining a fluid flow passage in communication with the interior volume of the bottle. The spout may have a length and diameter sufficient to activate filler neck closure members (e.g. flaps, valves, or other closure members). At least a portion of the spout may be devoid features which could compromise the operation of the closure mechanism in a fuel tank filler neck. The spout may include threads operable to engage a cap on the end of the spout. The threads may be separated by clearance features operable to avoid interference with a capless fuel system.

23 Claims, 6 Drawing Sheets

(56) References Cited

U.S. PATENT DOCUMENTS

| | | | |
|---|---|---|---|
| 2,169,686 | A | 8/1939 | Fabrice et al. |
| 2,596,034 | A | 5/1952 | Lambert, Jr. et al. |
| 3,511,403 | A | 5/1970 | Braun |
| 3,620,400 | A | 11/1971 | Braun |
| 3,973,941 | A | 8/1976 | Augeri |
| 3,981,412 | A | 9/1976 | Asmus et al. |
| 4,044,917 | A | 8/1977 | Vella et al. |
| 4,387,817 | A | 6/1983 | Wiles et al. |
| 4,643,330 | A | 2/1987 | Kennedy |
| 4,948,001 | A | 8/1990 | Magly |
| 5,509,564 | A | 4/1996 | Knoop et al. |
| 5,967,352 | A | 10/1999 | Repp et al. |
| 6,123,212 | A | 9/2000 | Russell et al. |
| 6,635,325 | B1 | 10/2003 | Hebert |
| 6,732,878 | B2 | 5/2004 | Gillen et al. |
| D528,162 | S | 9/2006 | Lucas et al. |
| 7,198,162 | B2 | 4/2007 | Francois et al. |
| 7,331,479 | B2 | 2/2008 | Oh |
| 7,891,518 | B2 | 2/2011 | Snyder et al. |
| D633,803 | S | 3/2011 | Murphy et al. |
| D640,560 | S | 6/2011 | Snyder et al. |
| D653,111 | S | 1/2012 | Snyder et al. |
| D653,551 | S | 2/2012 | Murphy et al. |
| D653,952 | S | 2/2012 | Snyder et al. |
| 8,118,198 | B1 | 2/2012 | Watson et al. |
| 8,157,133 | B2 | 4/2012 | Sawicki et al. |
| D662,825 | S | 7/2012 | Murphy et al. |
| D666,498 | S | 9/2012 | Snyder et al. |
| D672,241 | S | 12/2012 | Sawicki et al. |
| D673,856 | S | 1/2013 | Snyder et al. |
| D684,860 | S | 6/2013 | Mulr et al. |
| D684,863 | S | 6/2013 | Snyder |
| D687,305 | S | 8/2013 | Juna |
| D687,712 | S | 8/2013 | Juna et al. |
| D695,115 | S | 12/2013 | Juna |
| D696,124 | S | 12/2013 | Prero |
| D696,127 | S | 12/2013 | Juna |
| 8,616,406 | B1 | 12/2013 | Sawicki et al. |
| 8,616,407 | B2 | 12/2013 | Sawicki et al. |
| D696,952 | S | 1/2014 | Christian et al. |
| D697,810 | S | 1/2014 | Juna |
| D698,655 | S | 2/2014 | Juna |
| D699,117 | S | 2/2014 | Snyder et al. |
| 8,668,120 | B2 * | 3/2014 | Hall ..... B65D 25/44 222/207 |
| D707,566 | S | 6/2014 | Augustyn et al. |
| D708,940 | S | 7/2014 | Juna et al. |
| 2006/0113331 | A1 | 6/2006 | Snyder et al. |
| 2006/0278662 | A1 | 12/2006 | Sawicki et al. |
| 2010/0132838 | A1 | 6/2010 | Cisternino et al. |
| 2010/0204669 | A1 | 8/2010 | Knight et al. |
| 2010/0252586 | A1 | 10/2010 | Jimenez et al. |
| 2010/0264249 | A1 | 10/2010 | Sawicki et al. |
| 2011/0226721 | A1 | 9/2011 | Horstman et al. |
| 2011/0284589 | A1 | 11/2011 | Serrano et al. |
| 2011/0290756 | A1 | 12/2011 | Horstman et al. |
| 2012/0285579 | A1 | 11/2012 | Dudley et al. |
| 2013/0292425 | A1 | 11/2013 | Mulry et al. |
| 2013/0319572 | A1 | 12/2013 | Zweifel |
| 2014/0001179 | A1 | 1/2014 | Prero et al. |
| 2014/0110369 | A1 | 4/2014 | Laib et al. |
| 2014/0137985 | A1 | 5/2014 | Zitkovic et al. |
| 2014/0174602 | A1 | 6/2014 | Baker et al. |
| 2014/0209203 | A1 | 7/2014 | Dudley et al. |
| 2015/0013822 | A1 | 1/2015 | Baker |

FOREIGN PATENT DOCUMENTS

| | | | |
|---|---|---|---|
| EP | 2393718 | B1 | 8/2013 |
| GB | 2275047 | A | 8/1994 |
| GB | 2399559 | B | 7/2006 |
| JP | 11348953 | | 12/1999 |
| NL | 52357 | C | 4/1942 |
| RU | 2482039 | C2 | 5/2013 |
| WO | 2009/073137 | A1 | 6/2009 |

* cited by examiner

CATCH RELEASING CAPLESS FUEL-FILLER BOTTLE

CROSS-REFERENCE TO RELATED APPLICATIONS

This application is a non-provisional application that claims priority pursuant to 35 U.S.C. § 119(e) of U.S. Provisional Patent Application No. 62/033,103, filed Aug. 4, 2014, entitled "Bottle with Integral Filler Spout," and U.S. Provisional Patent Application No. 62/059,827, filed Oct. 3, 2014, entitled "Capless Fuel Filler Bottle," which are each hereby incorporated herein by reference their entirety.

TECHNICAL FIELD

This invention relates, generally, to containers for storing and dispensing liquids. More particularly, the invention relates to containers having an integral pouring spout portion which is operable to interact with and activate closure members in fuel tank filler necks.

BACKGROUND

Automotive products such as fuel additives are usually provided in the form of a fluid and typically are poured into the fuel tank of a motor vehicle by consumers. Frequently, fuel additives are provided in bottles which include a relatively long neck or spout which can be inserted into the filler neck of a fuel tank. Recently manufacturers of motor vehicles have begun equipping their fuel tanks with filler necks which include spring loaded interior flaps or other closure members. The purpose of these structures is to seal the fuel tank so as to prevent escape of fumes and limit unauthorized tampering with, or theft of, fuel. These features are configured so that insertion of a fuel pump nozzle into the filler neck will activate and open the spring loaded closure members. However, consumers have come to find that presence of the closure members makes it very difficult to pour fuel additives in to the tank or remove the fuel additive bottles from the fuel tank filler necks. In some instances the spout portions of prior art bottles may be insufficiently long, or of a sufficient diameter, to activate the closure members. In other instances, features such as threading, pouring lips or the like found on the spout can actually interfere with the operation of the closure members, possibly causing expensive-to-repair damage to them. In an attempt to overcome the shortcomings of prior art additive packages, consumers have been utilizing screwdrivers, dowels, knife blades, and like items to open the spring loaded closure members and allow for introduction of a fuel additive. As would be expected, in addition to being complicated and possibly damaging the closure members, such operations often result in spillage of the additive material.

As will be explained herein, these shortcomings may be overcome by containers for fuel additives and the like which are configured and operable to properly activate closure members associated with a fuel tank so as to allow an additive product to be introduced thereto. Furthermore, the discussion herein addresses other short comings such as providing for the fluid-tight closure of the packaging without comprising its operation and improving withdrawal of the additive bottle from the filler neck system. These and other advantages of will be apparent from the drawings, discussion, and description which follow.

SUMMARY

In accordance with various embodiments disclosed herein a sealable, capless fuel-tank filler system bottle is provided.

The bottle includes a storage portion defining an interior volume to retain a liquid therein. The bottle also includes a pouring spout extending from the storage portion and defining a throat in fluid communication with the interior volume of the storage portion. The pouring spout defines an opening connected to the throat for discharging the liquid. The pouring spout may including an external coupling mechanism to secure a cap thereon. The pouring spout may also define a clearance feature on the exterior of the pouring spout that interrupts the coupling mechanism. The clearance feature may be sufficiently smoother or lower than the external coupling mechanism to avoid catching on an interior protrusion within a fuel-tank filler neck.

In accordance with various embodiments, the bottle may further include a cap that engages the coupling mechanism to close the opening. The cap may engage the coupling mechanism, fluidly sealing the spout opening. A locking cap may be used that is placed on the end of a pouring spout. The coupling mechanism may substantially surround the exterior of the spout. The coupling mechanism may have a radial high portion and a radial low portion that is disposed proximally from the radial high portion. The radial high portion may tend to catch on an internal portion of the fuel-tank filler neck when aligned therewith. The bottle may be rotated to align the clearance feature with the internal protrusion thereby releasing the radial high portion from the protrusion allowing the bottle to be withdrawn axially.

In accordance with various embodiments, the clearance feature may extend beyond the coupling mechanism away from the opening. The spout may include a first portion that is proximal to and adjacent the coupling mechanism. The clearance feature may extend into the first portion to provide tactile feedback when the bottle is rotated within a filler neck and an internal protrusion of the filler neck enters the clearance feature. The first portion may have an external diameter similar to that of the coupling mechanism. The clearance feature may be oriented axially to permit withdrawal of the spout in a substantially straight axial direction from the filler neck. The clearance feature may have an external surface that has a radial height lower than the coupling mechanism. The spout has an axis, and the clearance feature has an external surface with a diameter less than the spout measured about the spout axis. The clearance feature may include a flat external surface. The clearance feature may include a plurality of clearance features. The clearance features may be disposed on diametrically opposite sides of the spout. The clearance features may include four clearance features.

In accordance with various embodiments, the coupling mechanism may include threads, and the clearance feature may interrupt the threads along an axial strip. The threads may have peaks and valleys, and the clearance feature may have an external surface that is radially lower than the peaks. The external surface of the clearance feature may extend radially lower than the valleys. The threaded portion may occupy between about 5% and 20% of the length of the pouring spout portion. The clearance feature may extend proximally beyond the threads. The coupling mechanism is disposed adjacent the opening. The clearance feature surface may be substantially smooth and protrusion free. The container portion may contain a fuel additive.

In accordance with various embodiments, a method for the delivery of a fluid product through a fuel-tank filler neck may be provided. The method may include inserting a pouring spout of a bottle with the pouring spout extending from a storage portion, with the pouring spout having a throat in fluid communication with the interior volume of the storage portion. The pouring spout may define an opening connected to the throat for discharging the liquid. The pouring spout may include an external coupling mechanism to secure a cap thereon and define a clearance feature on the exterior of the pouring spout that interrupts the coupling mechanism. The clearance feature may be sufficiently smooth or lower than the external coupling mechanism to avoid catching on an interior protrusion within the fuel-tank filler neck. At least a first door within the filler neck may be engaged with the pouring spout. The fluid product may be emptied into the fuel-tank. The bottle may be withdrawn from the filler neck of the fuel-tank. The bottle may be rotated in response to encountering an interference between the coupling mechanism and the filler neck. Rotation may be stopped in response to placing the clearance feature proximal to a portion of the filler neck causing the interference. The bottle may be continually withdrawn from the filler neck of the fuel-tank after the interference has been avoided.

DETAILED DESCRIPTION

Figure 1:
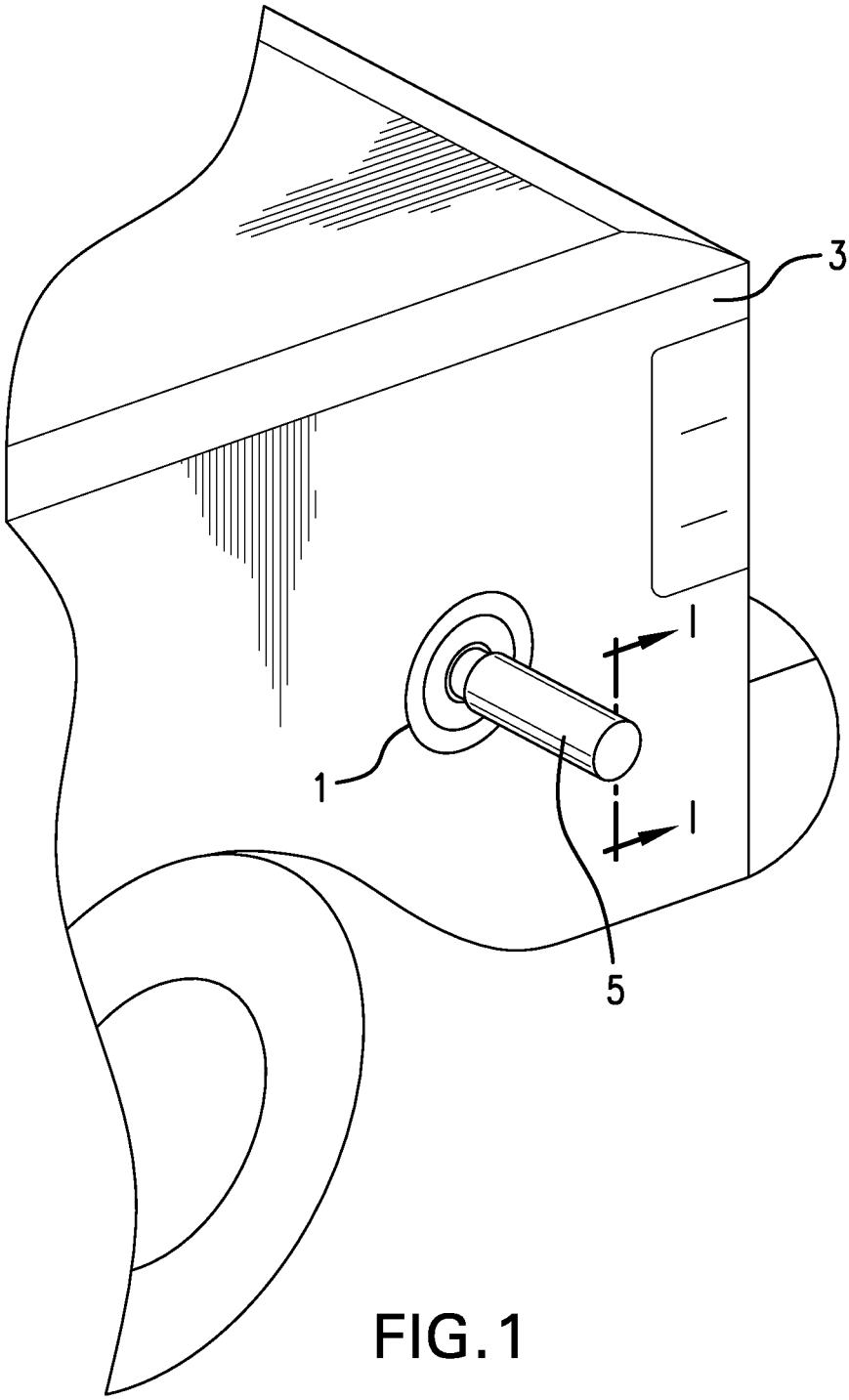
FIG. 1 is a perspective view of a container with a pouring spout portion engaged with a capless fuel system in accordance with various embodiments.

The subject matter of the disclosure herein may be described and implemented in various configurations and embodiments, and some particular embodiments may be described for purposes of explanation and illustration. However, it is to be understood that other embodiments are within the scope of the invention.

The present disclosure relates to a novel and advantageous fuel additive bottle that can be used in a capped and capless fuel system. The bottle (e.g., a fuel additive bottle) can include a container or body that is configured to hold a liquid, and a neck portion providing a spout extending from and in fluid communication with container. The bottle is preferably closed, except via the spout, to retain and seal the liquid therein until the spout is opened. The pouring spout may project from the bottle and has an interior surface defining a fluid flow passage (i.e. a throat) in communication with the interior volume of the bottle. The pouring spout may generally include an exterior surface which may define a generally cylindrical member (e.g. cylinder, oblong cylinder, frustum, conical or other design) having a smooth surface. The spout may have a length and diameter sufficient to activate filler neck closure members (e.g. flaps, valves, gates, or other closure members). At least a portion of the spout may be devoid of features which could otherwise increase the difficulty of removing the spout from the closure mechanism in a fuel tank filler neck. An example of a feature that may increase the difficulty of removing the spout from the closure mechanism may be threads at the end of the spout. As such, the threads may be formed such that they generally do not interfere with the closure member. For example, a portion of the spout may have a gap in the feature that protrudes from the lowest common surface, e.g., threads on the spout may be di-continuous along a longitudinal line. A portion of the surface may be consistent with or gradually taper from the rest of the surface of the spout. The threads themselves may also have a flat outer profile such that they limit interference with the closure member.

As a result of the combination of features discussed herein, the spout can readily be introduced and removed from the filler neck of a fuel tank. While the spout may be cylindrical and non-curved, it is to be understood that the spout may be slightly tapered with regard to its central axis, e.g. the spout may have a frustum shape. The filler spout is configured to activate and not damage, flaps, valves, or other closures members which may be included in the filler neck of a fuel tank. In that regard, its configuration may generally mimic the size and shape of a nozzle spout on a gasoline or diesel fuel pump similarly configured to insert into and activate internal flaps, valves, gates or other closures members on filler necks of vehicle fuel tanks. More specifically, the filler spout is configured to insert into and withdraw from a capless fuel system.

The sealable bottle may include a cap which is configured and operable to removably engage the spout and establish a fluid-tight seal which closes the fluid flow passage. A locking cap may be used that is placed on the end of a pouring spout. The sealing features may be such that the sealing function of the spout does not impede the activation of any closure members and the like, which are incorporated into the filler neck of the fuel tank. While the bottle is described herein as being a sealable bottle, other bottles without seals may likewise utilize the various structures and methods described herein.

Figure 2B:
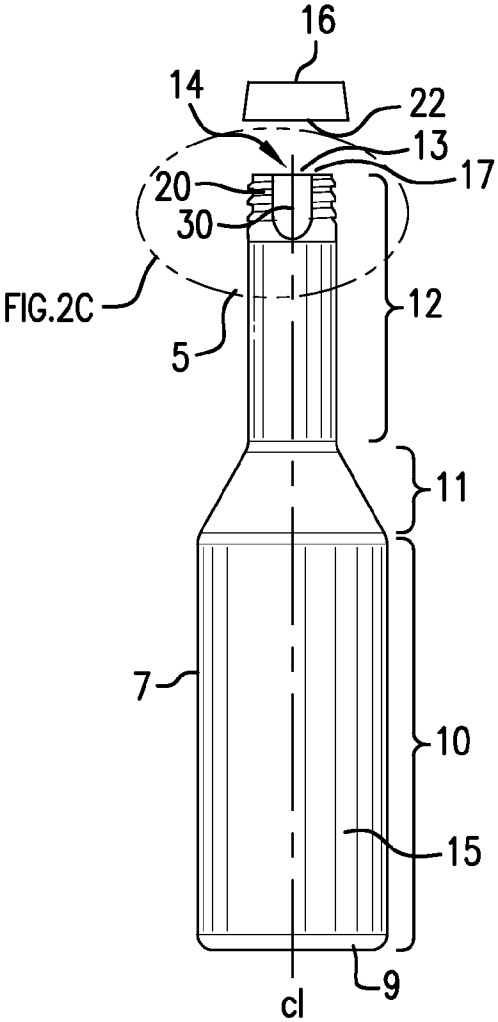
FIG. 2B is a side view of a bottle with a pouring spout portion in accordance with various embodiments.
Figure 2A:
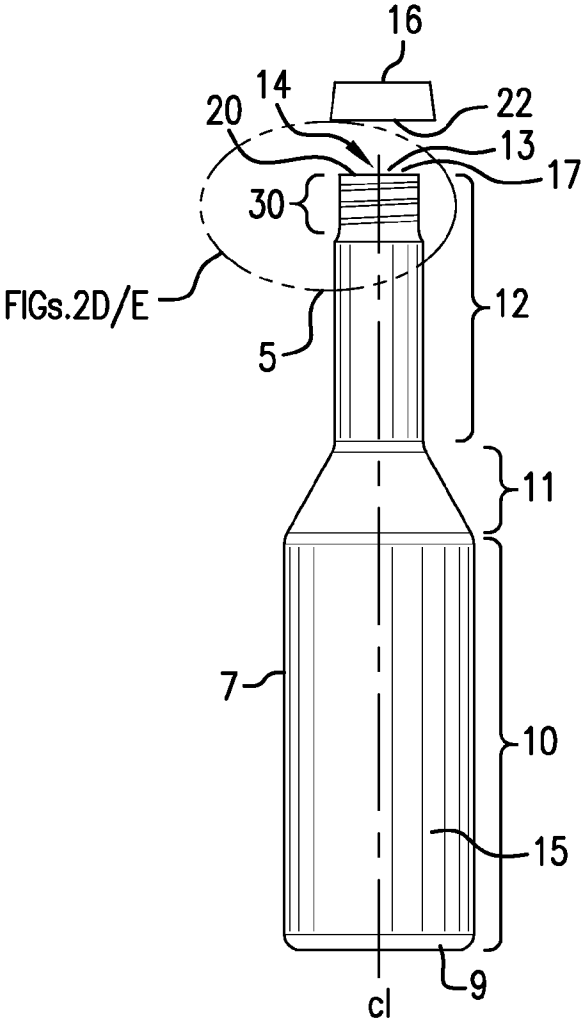
FIG. 2A is a front view of a bottle with a pouring spout portion in accordance with various embodiments.

Referring to FIG. 1, in accordance with various embodiments, a sealable bottle 5 may be inserted into a capless fuel system 1 on a vehicle 3. Referring to FIG. 2*a*, the sealable bottle 5 may include a storage portion 10 and a pouring spout portion 12. The storage portion 10 may be defined by one or more exterior walls 7 and a base 9. The exterior walls 7 and the base 9 may be sufficiently enclosed to contain a liquid therein. Thus, the storage portion 10 may define a container 15 which retains a liquid product such as a fuel additive therein. The storage portion 10 as shown in FIGS. 2A and 2B may be generally cylindrical. However, it is to be understood that other shapes of bottles may likewise be utilized.

In accordance with various embodiments, a neck may extend from the storage portion 10. A transition portion 11 may connect the storage portion 10 to the neck. The neck may have a smaller cross section than the storage portion 10 in order to allow access into a filler system or mere concentrate the flow of fluid. The neck may include a pouring spout portion 12. The pouring spout portion 12 may comprise only a portion of the neck or as illustrated in FIGS. 2A and 2B it may comprise the entire neck. The pouring spout portion 12 may enter the filler neck of the fuel tank while allowing the storage portion 10 to be a sufficient size to contain the fuel additive. The transition portion 11 may connect the storage portion 10 to the pouring spout portion 12. For example, with a cylindrical storage portion 10 and a cylindrical pouring spout portion 12, the transition portion 11 may be a frustum shape. The large diameter of the frustum shape may extend from the body portion 10 with the frustum shape narrowing to a smaller diameter that the pouring spout portion 12 extends from. As the storage portion 10 may be any shape, transition portion 11 may also have any shape sufficient to connect the pouring spout portion 12 and the storage portion 10. Transition 11 may also be a coupling mechanism between storage portion 10 and the pouring spout portion 12 allowing the pouring spout portion 12 to be removable.

In accordance with various embodiments, the pouring spout portion 12 may be an elongated engagement nozzle operable to enter into a fuel filler system. The pouring spout portion 12 may be sufficiently long to extend into the fuel filler system and activate buttons for opening access doors. The pouring spout portion 12 may define a fluid flow passageway 14 or a through, which defines an opening 13 through one end of the bottle 5. The fluid flow passageway 14 may be in fluid communication with the container 15 of the bottle 5. The pouring spout portion 12 may be generally cylindrical in shape and is not significantly curved along its longitudinal axis. In various embodiments, the pouring spout portion 12 mimics the size and shape of a fuel filler passage such that the pouring spout portion 12 may be inserted into the fuel filler passage. The length dimension of the pouring spout may be greater than its largest diameter. In general, the pouring spout portion 12 may have an exterior surface which extends from the transition 11 of at least 1 inch and in certain instances the pouring spout portion 12 may have a length of at least 1.5 inch, a length of at least 2 inches, a length of at least 3 inches, a length of at least 4 inches, or any length between 1 and 4 inches or greater than 4 inches. For example, the length may be about 2.5 inches. The exterior diameter of the surface of the spout is generally in the range of about 0.75-1.25 inch, although it is to be understood that in particular application these dimensions may vary. For example, the diameter may be about 0.8 inches. In specific instances, the length of the pouring spout portion 12 is greater than its largest diameter, and in specific instances at least twice its largest diameter or 3 times its largest diameter.

In accordance with various embodiments, the bottle 5 may include a cap 16 which is configured to engage the pouring spout portion 12 and establish and seal which closes the fluid flow passageway 14. The pouring spout portion 12 may include an external mechanical coupling mechanism operable to secure the cap 16 thereon. The mechanical coupling mechanism may have a feature on the exterior surface of the pouring spout portion 12 that could interfere with the withdrawal or insertion of the bottle 5 into the fuel filler neck. The feature may be defined as high and low points on the exterior surface of the pouring spout portion 12 with the low point proximal to the high point. In various other embodiments, as discussed below, the mechanical coupling mechanism may be any coupling device operable to engage with a cap or other closure. Examples of such coupling mechanisms may include threads, snap top ridges, child-seal closures, or the like. As illustrated in FIGS. 2-5B, the coupling mechanism may be a threaded portion 20. As shown in the various figures, the threaded portion 20 may be located immediately adjacent to the opening 17. However, in other embodiments the threaded portion 20 may be located at any positions along the pouring spout portion 12 with smooth portions located between the threaded portion 20 and the opening 17. The cap 16 includes corresponding threads 22 on its interior surface. The cap may be operable to receive the pouring spout portion 12 and rotated so as to engage the corresponding threads 20, 22 thereby sealing the bottle 5. The mechanical coupling mechanism and cap 16 may be a combination of any features and mechanisms known in the bottling industry including child-proof systems, tamper resistance systems, threaded systems, snap fit systems or the like.

In accordance with various embodiments, a seal, such as a tear-off foil or membrane seal may further be disposed atop the pouring spout portion 12 so as to close the passageway 14. Such a membrane or foil type seal, in addition to enhancing the integrity of the closure, provides indication of tampering. Any other technology known for improving the seal may additionally be applicable.

As the mechanical coupling mechanism 20 (e.g. threads 20) may be positioned at the end of the pouring spout portion 12 immediately adjacent to opening 17. The mechanical coupling mechanism 20 may be configured such that it does not significantly interfere with the closure mechanism in a fuel tank filler neck. Specifically, the mechanical coupling mechanism 20 may be operable to engage the cap 16 on the end of the pouring spout portion 12 and may be formed such that the mechanical coupling mechanism 20 generally does not interfere with the closure member.

In accordance with various embodiments, the mechanical coupling mechanism 20 (e.g. threads 20) may extend over only a portion of the length of the pouring spout portion 12. For example, the threads 20 may extend about 10% of the length of the pouring spout portion 12; the threads 20 may extend about 20% of the length of pouring spout portion 12; the threads 20 may extend about 30% of the length of the pouring spout portion 12; the threads 20 may extend about 40% of the length of the pouring spout portion 12; or the threads 20 may extend about 50% of the length of the pouring spout 12. In other examples, the threads 20 may extend in any ratio of 10-50% of the length of the pouring spout portion 12. As shown in FIG. 2B the threads may be radially coextensive with neck spout portion 12. In some embodiments, the threads may have a flat outer profile as shown in FIG. 2B. The flat radial diameter may be similar to the outer redial diameter of the pouring spout portion 12. Each of the flats may be wider than the troughs between allowing minimizing resistance from the threads themselves. In other embodiments the threads may have sharper peaks as shown in FIG. 4B. Any of a variety of different threads or other devices may be used.

As shown in FIGS. 2A and 2B, the mechanical coupling mechanism 20 may include a clearance element 30. In accordance with various embodiments, the clearance element 30 may be any feature configured to reduce the interference between the sealable bottle 5 (specifically the mechanical coupling mechanism 20) and the capless fuel system 1. The clearance element may define an axial gap or strip extending through the coupling mechanism (e.g. thread 20). The gap may be a portion of the coupling mechanism that is operable to avoid or minimize interferences within the filling neck of the fuel system. The clearance element may be a portion of the mechanical coupling mechanism that is altered or discontinuous to increase its smoothness or profile relative to the pouring spout. The clearance element 30 may be sufficiently smooth to avoid or reduce interference with the fuel system 1. Sufficiently smooth being defined as a surface that is smoother than the mechanical coupling such that protrusions are limited in their ability to snag on or interfere with structures adjacent to the pouring spout. Sufficiently smooth may have an uneven surface but one that is suitably consistent that it is unlikely to engage an adjacent protrusion. Any surface, strip, or line formed by the clearance element 30 may face radially outward on the exterior of the pouring spout.

In accordance with various embodiments, the clearance element 30 may recess inwardly from the exterior surface of the bottle 5 or the outer most portion of the coupling mechanism. The clearance element 30 may be a recess that is formed toward the centerline (shown in the drawings as c1) of the sealable bottle 5. The clearance element 30 may form at least a portion of the outer surface of the bottle 5. In the portion of the outer surface of the bottle 5 formed by the clearance element 30, this surface may be radially positioned at or closer to the centerline of the bottle 5 than the coupling mechanism. Any outward extension from the interior of the bottle 5 (e.g. the centerline) may be minimized beginning at the portion of the clearance element 30 closest to the base 9 and proceeding to the opening 17. The end of the bottle proximal to the opening may have the coupling mechanism, e.g. threads 20, which extend outwardly from the interior of the bottle and then recess inwardly between each adjacent thread and again extend outwardly at the next thread. In various embodiments discussed herein, the clearance element 30 may have no threads. Or, the clearance element 30 may have reduced threads relative to other thread portions of the bottle. The clearance element 30 may have no or limited protrusions, steps, flares, or features that extend outwardly from the interior of bottle 30. The absence of or minimization of the outwardly extending features is relative to the longitudinal direction of the body (i.e. the direction running along the centerline of the body). This longitudinal direction may also be described as the surface of the bottle along a single line that progresses linearly along the exterior surface from the base 9 to the opening 17. The spout portion 12 may have at least one longitudinal line that does not have outwardly extending features, but instead any change in the surface may be toward the interior of the bottle 1 (e.g. the bottle may step, taper, or otherwise contract toward the interior and not enlarge).

Figure 2C:
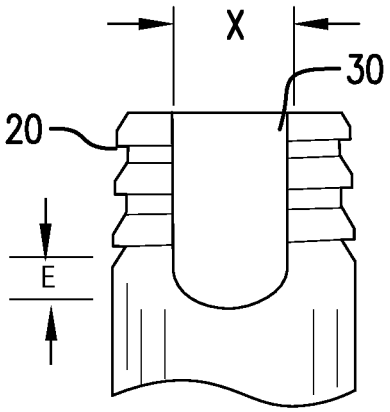
FIGS. 2C-2E are detail views of the clearance element shown in FIGS. 2A and 2B.
Figure 2D:
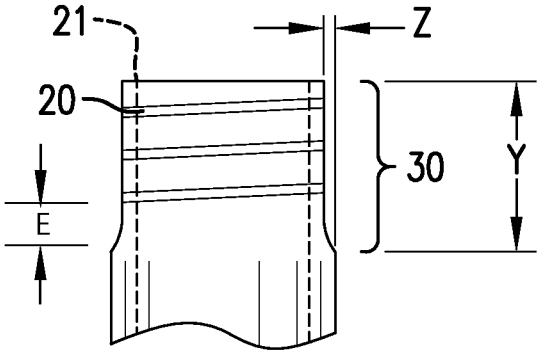
Figure 2E:
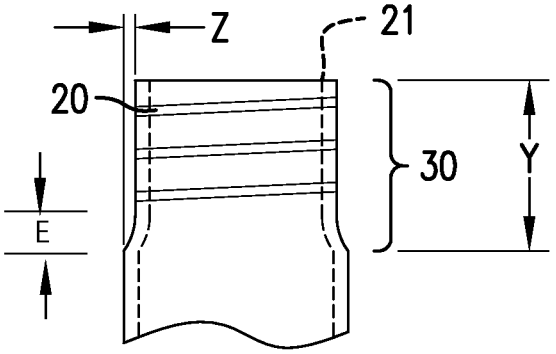

In accordance with various embodiments, the clearance portion may extend beyond the mechanical coupling mechanism and away from the opening toward the base. As shown in FIGS. 2C-2E, the extension may be a distance of E onto the portion of the pouring spout between the threads and the container. In one example, the distance E may extend from the mechanical coupling mechanism to the container portion. In another embodiment, the clearance element extension may have a distance E that is about half the axial length of the mechanical coupling mechanism to about four times the length of the mechanical coupling mechanism. The clearance element 20 may extend gradually up in a sloped manner to meet the pouring spout or the clearance element may terminate abruptly forming an inward step toward the centerline from the outer radial surface of the pouring spout.

Figure 3C:
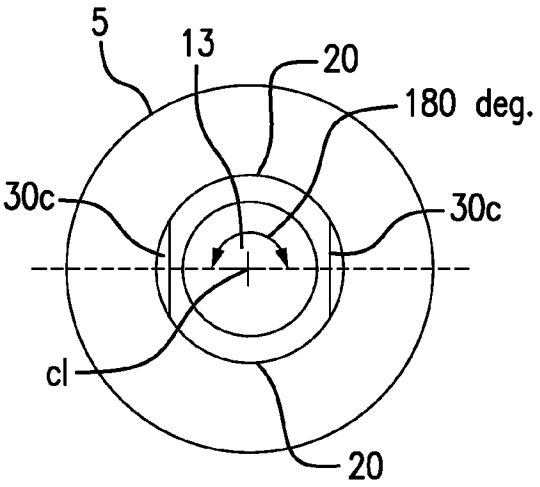
FIG. 3C is a top view of a bottle with a pouring spout portion in accordance with various embodiments.
Figure 3B:
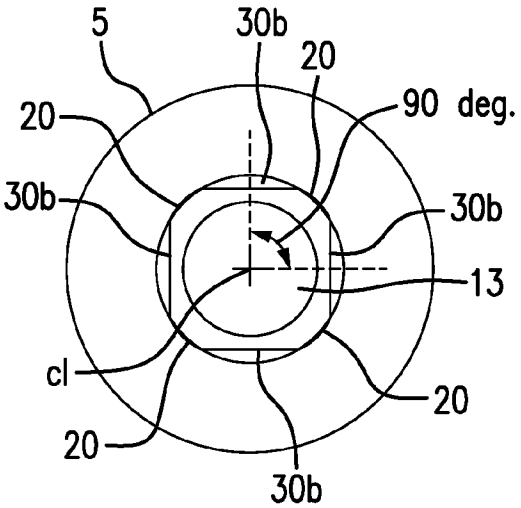
FIG. 3B is a top view of a bottle with a pouring spout portion in accordance with various embodiments.
Figure 3A:
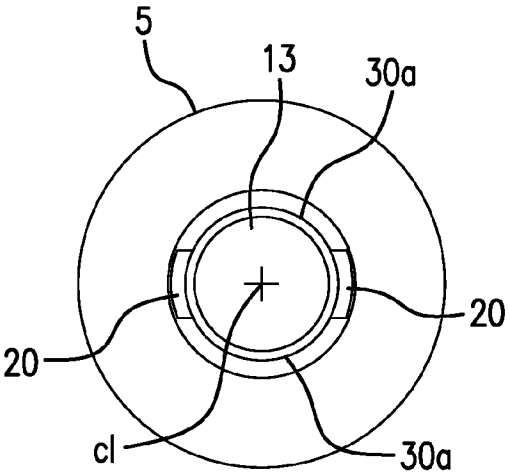
FIG. 3A is a top view of a bottle with a pouring spout portion in accordance with various embodiments.

As illustrated in FIG. 3A-FIG. 3C with a top view of a bottle having a pouring spout portion, the clearance element 30 may include any of a variety of forms operable to simplify withdrawing the bottle from the fuel tank filler neck. In accordance with various embodiments, as shown in FIG. 3A, the threaded portion 20 may comprise discrete portions with no thread portions connecting each of the separate discrete threaded portions 20. The clearance element 30*a* may be defined by the portions of the surface without threads between each of the discrete thread portions 20. The clearance element 30*a* may be one which generally follows the perimeter design of the bottle. For example, as shown in FIG. 3A the bottle 5 is generally cylindrical and the clearance element 30*a* is also a generally cylindrical surface extending between a first discrete thread portion and the second discrete thread portion.

In accordance with various embodiments, as shown in FIGS. 3B and 3C, the threaded portion 20 may comprise discrete portions with no thread portions connecting each of the threaded portions 20. The clearance element 30*a* may be defined by the portions of the surface without threads between each of the discrete thread portions 20. In some embodiments, the clearance element 30*a* may form its own separate perimeter departing from the perimeter design of the bottle. For example, as shown in FIG. 3B-3C, the bottle 5 is generally cylindrical and the clearance element 30*a* is not a generally cylindrical surface but instead is a flat surface which extends between the first discrete thread 20 portion and the second discrete thread portion 20. In other embodiments, the clearance element 30 may follow the perimeter of the bottle mimicking its shape.

The clearance element 30 may be defined by any of a variety of surfaces that reduce or eliminate interference with a capless filler system. In various examples, the surface may be flat, concave, or convex. In various examples the surface may have any profile operable to have a longitudinal profile without or with minimal outward protrusions. FIGS. 2C-2E illustrate various examples of the clearance element 30. For example, the clearance element 30 may include a surface (e.g. flat, convex, concave, or the like) proximal to the bottle opening. The surface may have a width X as shown in FIG. 2C. In one example, the clearance element 30 may be a flattened surface (e.g. flattened with respect to the profile of the threads or the neck) with a width that may be between about ¼ to about ¾ of the width of the opening of end of the bottle. In one example, the width may be about ½ of the width of the opening of the end of the bottle. In various examples, the width may be about 0.5-1.5 cm wide. In various examples, the width may be about 0.8 cm wide. The surface may have a longitudinal length Y as shown in FIGS. 2D-2E. In one example, the length Y may be coextensive with the longitudinal length of the threads. In one example, the length Y may be longer than the longitudinal length of the threads. In one example, the length Y may be shorter than the longitudinal length of the threads. In one example, the length Y may be less than or about ½ the length of the neck. In one example, the length Y may be between ⅛ and ¼ of the length of the neck. In one example, the length Y may be between ⅙ and ⅓ of the length of the neck. In one example, the length Y may be between about ½ and 1½ cm. In one example, the length Y may be about 1 cm.

In accordance with various embodiments, the clearance element 30 may extend to the root of the thread or less. For example, the clearance element may be tangential with the surface of the neck of the bottle defined by the root of the thread. In other embodiments, the clearance element 30 may extend below the threads into the wall of the bottle 5. For example, the clearance element may thin the wall of the bottle proximal to the clearance element 30. FIGS. 2D and 2E show the inner surface of the bottle wall 21. FIG. 2D illustrates the wall being thinned with the outer surface of the wall and the inner surface of the wall being closer together proximal the opening than distal to the opening of the bottle. This may be accomplished by forming the bottle with a surface that passes through both the threads and the wall thickness. E.g., if cut, such as in a machining process, the wall and the threads are cut to form the surface defining the clearance element 30. If formed, a thinner wall without threads is formed in the area of the clearance element. FIG. 2E illustrates an example of a wall that is not thinned but remains approximately the same thickness. While discussed herein as a flat surface the surface may also be concave as viewed from the exterior of the body, causing a portion of the threads and/or wall to be thicker at the exterior perimeter of the surface than the interior. Conversely, the surface may also be convex having the perimeter of the surfacing having thinner threads and/or walls than the interior of the surface.

As shown in FIG. 3C, the clearance element 30*a* may include two opposing (i.e. 180 degree position relative to one another as measured about the longitudinal axis) clearance elements 30*c*. However, the clearance elements 30*c* may also be located in positions other than opposing one another. The clearance elements 30*c* may be positioned at 90 degrees, 60 degrees or any another other position. The bottle 5 may have at least one clearance element as shown in FIG. 3B, the bottle 5 may include two or more clearance elements 30*b*. For example, as shown, the bottle 5 may include 4 clearance elements 30*b*. These clearance elements 30*b* may be positioned at any radial intervals such as less than 90 degree intervals, more than 90 degree intervals or 90 degree intervals as shown in FIG. 3B. The clearance elements may be placed at 12:00 o'clock, 3:00 o'clock, 6:00 o'clock, and or 9:00 o'clock relative to one another. The clearance elements may be placed at constant intervals or the intervals may be random.

Figure 4A:
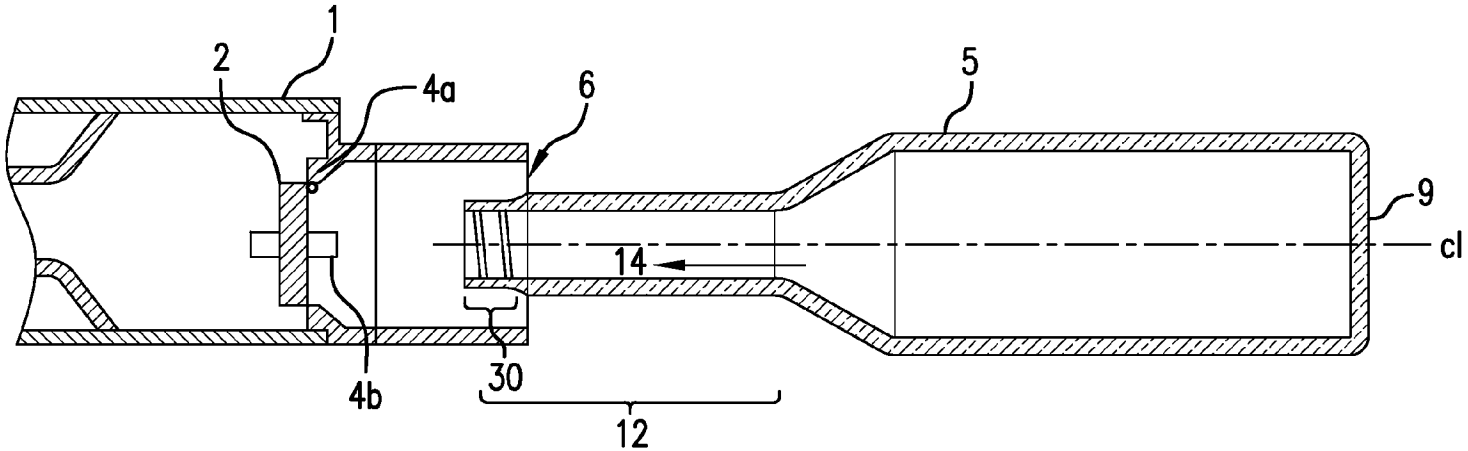
FIG. 4A is a cross sectional view of the container of FIG. 1 before engagement with a locking capless fuel system as viewed along cross section I-I in accordance with various embodiments.
Figure 4B:
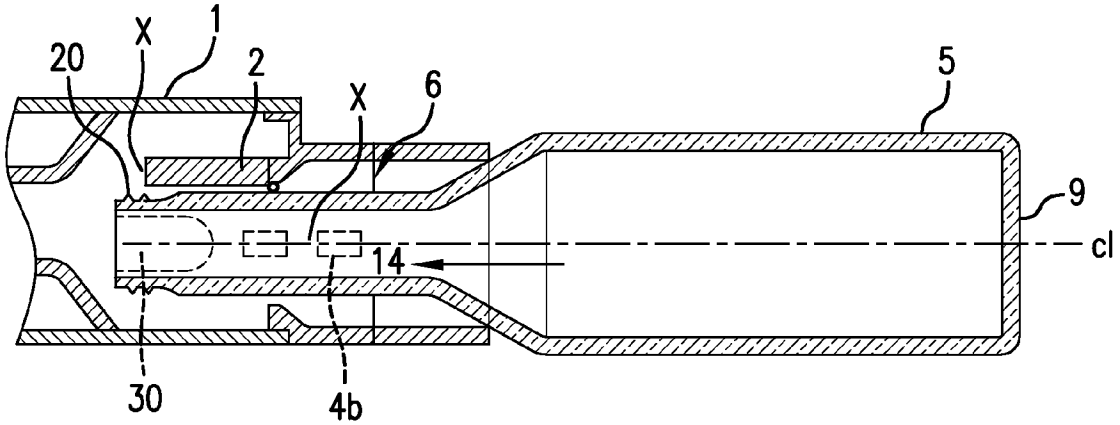
FIG. 4B is a cross sectional view of the container of FIG. 1 engaged with a locking capless fuel system as viewed along cross section I-I in accordance with various embodiments.

FIGS. 4A-FIG. 4B shows a cross sectional view of the container 5 of FIG. 1. The views are shown as viewed along cross section I-I in accordance with various embodiments. FIG. 4A illustrates an example of the relationship of the bottle 5 with the capless fuel system 1. The capless fuel system 1 may include a variety of system types operable to seal the filler system and/or limit access to the system, reducing theft or vandalism. One example of such a system is the Ford capless fuel system. This system may have a fuel door 2 that covers and closes the fuel system filler port. Door 2 can be spring loaded or otherwise biased towards a closed position, and can be locked in place by a door release locking mechanism 4*a*. Locking mechanism 4*a* can include a plurality of disengagement elements, such as tabs 4*h*, such that locking mechanism 4*a* does not disengage unless all of the plurality of tabs 4*b* are engaged (although it is foreseen that the locking mechanism could be configured to unlock if less than all of the tabs are engaged). For example, when tabs 4*b* are depressed radially outwardly, door 2 can be unlocked and moved into an open position by the pouring spout 12. Alternatively, the depression of tabs 4*b* can cause door 2 to be moved into an open position automatically in some embodiments, optionally allowing the pouring spout 12 to enter further into capless fuel system 1, and allowing the fluid flow passageway 14 to dispense the liquid from the container 15. When the pouring spout 12 is removed from the filler port of the fuel system, tabs 4*b* are released, and the door 2 is closed and locking mechanism 4*a* relocks the door 2. As shown, the bottle 5 is positioned just outside of a cap door 2 before engagement with a locking capless fuel system 1. The bottle 5 may be inserted though opening 6 on the capless fuel system 1. As shown in FIG. 4B, the bottle 5 may be pushed into the system until the top rim 17 of the bottle engages the door 2. The bottle 1 (for example the threads or the neck on the bottle) may also engage tabs 4*b* releasing the lock on door 2 causing the door 2 to swing in a clockwise (as viewed in the position of FIGS. 4A and 4B) direction opening the capless fuel system. The bottle 5 may be pushed into the system, allowing the contents of the bottle 5 to empty into the vehicle fuel tank. In various embodiments, the clearance element 30 may be operable to engage the tabs 4*b*. For example, the clearance element 30 may be sufficiently large in diameter to sufficiently depress the tabs 4*b* to release the locking mechanism 4*a* allowing for full insertion of the bottle 5.

The mechanical coupling mechanism 20 on the open end of the bottle 5 may have a tendency to interfere with interior features of the capless system 1 upon withdrawal of the bottle 5 from the capless system 1. These interior features may include the door 2 or the locking mechanisms 4*a* or tabs 4*b*. The clearance element 30 may be operable to avoid these interferences. For example, in embodiments in which the mechanical coupling mechanism 20 includes a threaded portion and these threads engage with and interfere with the door 2 at, for example, interference point X proximal to the free end of the door 2, the bottle may be rotated such that the clearance element 30 is proximal to that same interference point X. As the clearance element 30 may have less of an outwardly protruding feature or fewer outwardly protruding features than the mechanical coupling mechanism 20 does, the clearance element 30 may slide past the door 2 with either less or no interference as compared to the mechanical coupling mechanism 20. Providing a broad flat (also concave or convex) surface may better allow the interference point X to avoid the mechanical coupling mechanism 20. If the locking mechanism 4*a* or the tabs 4*b* are interfering with the removal of the bottle 5, the bottle 5 may be likewise turned until the clearance mechanism is proximal to these interference points and thus allowing the bottle to be more easily removed.

Figure 5A:
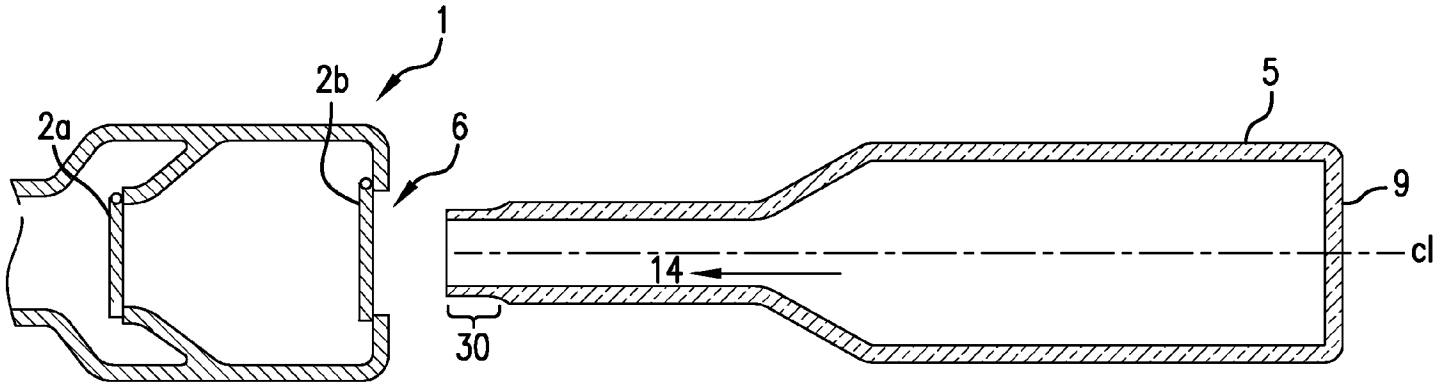
FIG. 5A is a cross sectional view of the container of FIG. 1 before engagement with a double gate capless fuel system as viewed along cross section I-I in accordance with various embodiments.
Figure 5C:
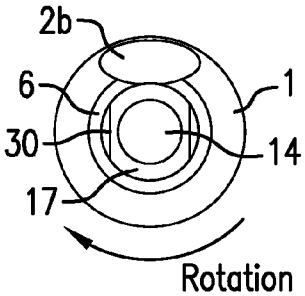
FIG. 5C is a cross sectional view of the container of FIG. 5B with the threads of the bottle interfering with the door as viewed along cross section II-II in accordance with various embodiments.
Figure 5D:
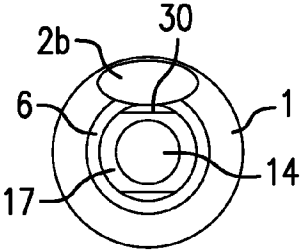
FIG. 5D is a cross sectional view of the container of FIG. 5B with the bottle rotated in the direction shown in FIG. 5C so the threads of the bottle do not interfere with the gate as viewed along cross section II-II in accordance with various embodiments.
Figure 5B:
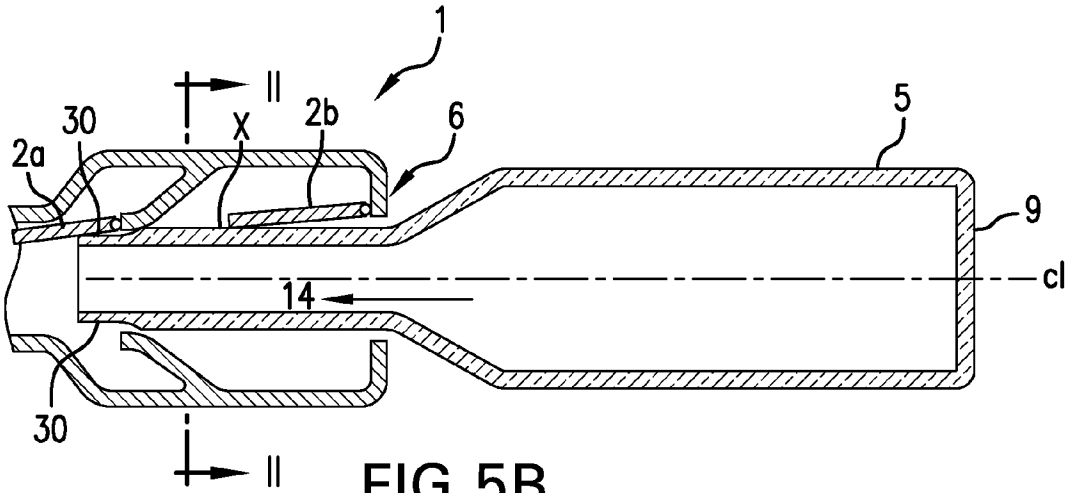
FIG. 5B is a cross sectional view of the container of FIG. 1 engaged with a double gate capless fuel system as viewed along cross section I-I in accordance with various embodiments.

FIG. 5A is a cross sectional view of a view of the container of FIG. 1 before engagement with a double gate capless fuel system as viewed along cross section I-I in accordance with various embodiments. As shown here, the bottle 5 may be inserted into the opening 6 of system 1 through an outer door 2*b* into the interior of the capless system and through the inner door 2*b*. As used herein, the doors 2*a*, 2*b*, (and door 2 discussed above) may be any variety of gates barriers, or other mechanisms used to block the flow of fluids, gasses or other material in capless systems. FIG. 5B is a cross sectional view of a view of the bottle 5 engaged with the double door capless fuel system 1 in accordance with various embodiments. As shown in this figure, the interference point X may occur at the outer door 2*b*. However in various embodiments, the pouring spout may extend far enough into the capless system that the interference point X may also or alternatively occur at the inner door 2*a*. The bottle may be rotatable such that the clearance element 30 may be aligned with either or both of these doors such that the interference is relieved by the presence of the clearance element 30. FIG. 5C shows cross sectional view of the container of FIG. 5B from within the system 1 with the threads 20 of the bottle 1 interfering with the gate 2*b* as viewed along cross section II-II in accordance with various embodiments. By rotating the bottle shown by the arrow, the clearance element 30 may be aligned with the door 2*b* as shown in FIG. 5D. FIG. 5D shows a cross sectional view of the container of FIG. 5B with the bottle rotated in the direction shown in FIG. 5C so the threads of the bottle do not interfere with the gate as viewed along cross section II-II in accordance with various embodiments. Once in this position the bottle 5 may be removed from the capless system 1. Elements of the capless fuel systems which cause interference may be caused by part of the OEM design or they may be caused by failures of the OEM design. Also the interference may be caused by other unexpected issues such as debris or the like. The bottle design as discussed herein may improve removal over each of these issues.

Various methods of using the fuel additive bottle described herein may be employed. For example, a method for the delivery of a fluid product through a capless filler neck of a fuel-tank may include inserting a pouring spout portion of a bottle into the capless filler system. The pouring spout portion may extend from a storage portion (i.e. a fluid reservoir). The pouring spout portion having an interior fluid flow passage in communication with the interior volume of the bottle. The fluid flow passageway may define an opening in the spout. The spout may include a cap attachment mechanism such as threads. The spout may also include a clearance feature proximal to the opening on the spout. The spout may engage at least a first door within the capless filler neck with the pouring spout portion. The fluid product contained within the bottle may be emptied into the fuel-tank. The bottle may be withdrawn from the capless filler neck of the fuel-tank. Upon withdrawal the bottle may catch on an interference. In response to interference between the engagement mechanism and the capless system, the bottle may be rotated. Ideally the bottle is operable to be pulled out with minimal rotation. The number and dimensions of the clearance feature may influence the amount of rotation that it takes to avoid the interference. The rotation may be stopped in response to placing the clearance feature proximal to a portion of the filler neck causing the interference. Once the clearance feature is proximal to the interference location the bottle may be completely withdrawn from the capless filler neck of the fuel-tank.

Other bottle configurations may also be applicable in addition to the embodiments discussed herein or alternatively to the embodiments discussed herein. Examples of applicable embodiments may be disclosed in U.S. application Ser. No. 13/841,317 entitled "Fuel additive bottle for a capless fuel system," which is hereby incorporated by reference. As disclosed therein, the cap member engages an outer surface of the spout by means of threads, but other embodiments may also be implemented in which the cap engages the spout by means of threads internal to the spout. In such instances, the spout retains a smooth exterior surface devoid of any features which could interfere with its activation of closure members associated with a fuel tank filler neck.

While the foregoing shows use of threaded couplers (e.g. the threaded portion 20,22) between the cap, and the bottle, it will be readily apparent to those of skill in the art that other coupling arrangements such as locking tabs, flanges, compression fittings, and the like may be adapted for use in the present invention. Other coupling device may likewise be incorporated such that the coupling device maintains an exterior surface of the pouring spout such that it does not interfere with the closure mechanism. The clearance feature 30 may be situated within any coupling device. In such an embodiment, less material protrudes outside of the surface of the pouring spout, due to the clearance mechanism making it suitable to engage the closure mechanism. In other embodiments, the pouring spout may include a child-proof caps which may include a device that receives a push down and twist action to release the cap from the bottle. The clearance mechanism may apply to these features as well.

Also, while the foregoing description and discussion describes the pouring spouts as being non-curved along its length axis, it is to be under stood that in various embodiments of the invention the non-curved pouring spout may join the bottle through a curved, corrugated, or flexible connection so as to accommodate space limitations, bottle configurations, aesthetics, or the like. The straight, feature-free portion of the assembly may be considered the pouring spout or in other embodiments the entire portion may be considered the pouring spout.

The bottle assemblies of the present invention may be fabricated from materials typically employed for packages of this type. In most instances, the packaging will be fabricated from polymeric materials, and in particular, thermoplastic polymeric materials such as polyethylene, polypropylene, and the like. The packaging of the present invention may be readily manufactured by conventional forming techniques such as blow molding, rotational molding, injection, extrusion, and the like. In some instances, the bottle assemblies, or at least portions thereof, may be fabricated from other conventional materials such as metals, glass, and the like used either singly or in combination. All of such embodiments are within the scope of the present invention.

In view of the teaching presented herein, other modifications and variation of the invention will be apparent to those of skill in the art. The foregoing drawings, discussion, and description are illustrative of some specific embodiments of the present invention but are not meant to be limitations upon the practice thereof. It is the following claims, including all equivalents, which define the scope of the invention.

I claim:

1. A sealable, capless fuel-tank filler system bottle, comprising: a bottle that includes:

a storage portion defining an interior volume to retain a liquid therein;

a pouring spout extending from the storage portion and defining a throat in fluid communication with the interior volume of the storage portion, the pouring spout defining an opening connected to the throat for discharging the liquid, the pouring spout including an external coupling mechanism to secure a cap thereon and defining a clearance feature on the exterior of the pouring spout that interrupts the coupling mechanism, the clearance feature forming a flat region having a diameter at a height lower than the coupling mechanism and extending through the coupling mechanism to the pouring spout opening, the clearance feature being sufficiently smoother than the external coupling mechanism to avoid catching on an interior protrusion within a fuel-tank filler neck.

2. The bottle of claim 1, further comprising a cap that engages the coupling mechanism to close the opening.

3. The bottle of claim 2, wherein the cap engages the coupling mechanism, fluidly sealing the spout opening.

4. The bottle of claim 1, wherein the coupling mechanism substantially surrounds the exterior of the spout.

5. The bottle of claim 1, wherein the coupling mechanism has a radial high portion and a radial low portion that is disposed proximally from the radial high portion, wherein the radial high portion tends to catch on an internal portion of the fuel-tank filler neck when aligned therewith, wherein when the bottle is rotated to align the clearance feature with the internal protrusion thereby releasing the radial high portion from the protrusion and the bottle can be withdrawn axially.

6. The bottle of claim 1, wherein the clearance feature extends beyond the coupling mechanism away from the opening.

7. The bottle of claim 6, wherein the spout includes a first portion that is proximal to and adjacent the coupling mechanism, the clearance feature extending into the first portion to provide tactile feedback when the bottle is rotated within a filler neck and an internal protrusion of the filler neck enters the clearance feature.

8. The bottle of claim 7, wherein the first portion has an external diameter similar to that of the coupling mechanism.

9. The bottle of claim 1, wherein the clearance feature is oriented axially to permit withdrawal of the spout in a substantially straight axial direction from the filler neck.

10. The bottle of claim 1, wherein the clearance feature has an external surface that has a radial height lower than the coupling mechanism.

11. The bottle of claim 1, wherein the spout has an axis, and the clearance feature has an external surface with a diameter less than the spout measured about the spout axis.

12. The bottle of claim 1, wherein the clearance feature includes a flat external surface.

13. The bottle of claim 1, wherein the clearance feature comprises a plurality of clearance features.

14. The bottle of claim 13, wherein the clearance features are disposed on diametrically opposite sides of the spout.

15. The bottle of claim 13, wherein the clearance features comprise four clearance features.

16. The bottle of claim 1, wherein the coupling mechanism comprises threads, and the clearance feature interrupts the threads along an axial strip forming reduced flat threads extending into the flat region such that a wall of the pouring spout and the threads together form the flat region.

17. The bottle of claim 16, wherein the threads have peaks and valleys, and the clearance feature has an external surface that is radially lower than the peaks.

18. The bottle of claim 17, wherein the external surface of the clearance feature extends radially lower than the valleys.

19. The bottle of claim 16, wherein the threaded portion occupies between about 5% and 20% of the length of the pouring spout portion.

20. The bottle of claim 16, wherein the clearance feature extends beyond the threads away from the opening.

21. The bottle of claim 1, wherein the coupling mechanism is disposed adjacent the opening.

22. The bottle of claim 1, wherein the container portion contains a fuel additive.

23. A method for the delivery of a fluid product through a fuel-tank filler neck comprising:

inserting a pouring spout of a bottle into the filler neck of a fuel-tank, with the pouring spout extending from a storage portion, the pouring spout having a throat in fluid communication with the interior volume of the storage portion, the pouring spout defining an opening connected to the throat for discharging the liquid, the pouring spout including an external coupling mechanism to secure a cap thereon and defining a clearance feature on the exterior of the pouring spout that interrupts the coupling mechanism, the clearance feature forming a flat region having a diameter at a height lower than the coupling mechanism and extending through the coupling mechanism to the pouring spout opening, the clearance feature being sufficiently smoother than the external coupling mechanism to avoid catching on an interior protrusion within the fuel-tank filler neck;

engaging at least a first door within the filler neck with the pouring spout;

emptying the fluid product into the fuel-tank;

withdrawing the pouring spout of a bottle from the filler neck of the fuel-tank;

rotating the bottle in response to encountering an interference between the coupling mechanism and the filler neck;

stopping rotation in response to placing the clearance feature proximal to a portion of the filler neck causing the interference; and continuing to withdraw the bottle from the filler neck.

* * * * *